US007341151B2

(12) United States Patent
Takagi

(10) Patent No.: US 7,341,151 B2
(45) Date of Patent: Mar. 11, 2008

(54) CUSHIONING MATERIAL AND PACKING MATERIAL FOR DISPLAY MODULE AND TRANSPORT METHOD FOR DISPLAY MODULE

(75) Inventor: Koji Takagi, Kanagawa (JP)

(73) Assignee: NEC LCD Technologies, Ltd., Kanagawa (JP)

( * ) Notice: Subject to any disclaimer, the term of this patent is extended or adjusted under 35 U.S.C. 154(b) by 0 days.

(21) Appl. No.: 11/398,541

(22) Filed: Apr. 6, 2006

(65) Prior Publication Data

US 2006/0226047 A1 Oct. 12, 2006

(30) Foreign Application Priority Data

Apr. 7, 2005 (JP) ..... 2005-111451

(51) Int. Cl.
*B65D 85/48* (2006.01)

(52) U.S. Cl. ..... 206/454; 206/587; 211/41.1

(58) Field of Classification Search ..... 206/305, 206/320, 449, 454, 485, 486, 521, 523, 525, 206/526, 576, 587, 591; 211/41.1, 41.14
See application file for complete search history.

(56) References Cited

U.S. PATENT DOCUMENTS 5,515,976 A * 5/1996 Moren et al. ..... 206/586
6,145,663 A * 11/2000 Kim et al. ..... 206/454
6,811,028 B2 * 11/2004 Kim et al. ..... 206/587
6,997,318 B2 * 2/2006 Park ..... 206/454

FOREIGN PATENT DOCUMENTS

JP 11-100087 4/1999

* cited by examiner

*Primary Examiner*—Luan K Bui
(74) *Attorney, Agent, or Firm*—Young & Thompson

(57) ABSTRACT

An LCD module covered a protective film and stored in a vinyl bag is held by cushioning material, and the cushioning material is placed in a box. A plurality of grooves are formed in a mutually parallel fashion on the lower and upper members of the cushioning material. The grooves form a supporting portion for supporting the edges of LCD modules that are fitted in the grooves. The depth of the grooves is slightly less than the width of the frame area of the LCD modules. An upwardly protruding convexity is formed in the area between the grooves and on both sides of the rows comprising the plurality of grooves. The convexity is a pop-out prevention portion for preventing LCD modules from popping out from the cushioning material during transport. Soiling can thereby be prevented from occurring on the display area of the display modules.

15 Claims, 13 Drawing Sheets

CUSHIONING MATERIAL AND PACKING MATERIAL FOR DISPLAY MODULE AND TRANSPORT METHOD FOR DISPLAY MODULE

BACKGROUND OF THE INVENTION

1. Field of the Invention

The present invention relates to cushioning material for protecting a display module provided with a display screen having a display area and a frame area around the periphery of the display area, to packing material for packing the display modules when the display modules are to be transported, and to a transport method for display modules in which the packing material is used.

2. Description of the Related Art

Conventionally, when LCD (Liquid Crystal Display) modules and other flat display modules are transported, the display modules are packed with cushioning material, and are protected from impact, soiling, and other unwanted events (refer to FIG. 1 of Japanese Laid-Open Patent Application No. 11-100087, for example). FIG. 12 is a perspective view showing conventional cushioning material described in the prior art.

Conventional cushioning material 201 is formed by laminating unidirectionally corrugated paper in the paper surface direction so that the extended direction of the corrugations do not match, as shown in FIG. 12. In the cushioning material 201, a bottom portion 202 and a pair of side portions 203 that stand erect from both ends of the bottom portion 202 are provided, and the overall shape is a U-shape. A plurality of pairs of notches 204 are formed on the faces of the sides facing each other in the pair of side portions 203. Both ends of a plurality of LCD modules 101 are held between the pairs of notches 204, and the modules are held within the cushioning material 201.

FIG. 13 is a perspective view showing an LCD module, and FIG. 14 is a front view showing the LCD module during transport. The LCD module is a unit in which the following components are housed in a case: a liquid crystal panel obtained by placing a liquid crystal layer between two transparent substrates, a drive circuit for driving the liquid crystal panel, and a backlight for shining light on the liquid crystal panel are housed in a case. The display screen 102 of the LCD module 101 is made up of a display area 103 that is positioned in the center of the display screen, and a frame area 104 that is positioned around the periphery of the display area, as shown in FIG. 13. The uppermost surface of the display area 103 is composed of a polarizing plate.

When the LCD module 101 is to be transported, a protective film 111 is applied in order to protect the display area 103, as shown in FIG. 14. The protective film 111 is applied to the display screen 102 with tape 112 so as to cover the display area 103. The protective film 111 is a film made of a transparent polycarbonate resin, for example, and is coated with an antistatic material. The protective film 111 prevents soil caused by electrostatic charge or the like from being deposited on the display area 103 of the LCD module 101.

The LCD module 101 covered with the protective film 111 is placed and packed in a vinyl bag (not shown). The bag protects the LCD module 101 from dirt, electrostatic charge, dust, moisture, and the like. In this manner, the LCD module 101 is placed in the cushioning material 201 while the display screen 102 is covered with the protective film 111 and the module is packed in the vinyl bag, and is transported together with the cushioning material 201.

However, the prior art described above has the following problems. When LCD modules are transported using the conventional transport method, soiling occurs on the display area of the LCD module. FIG. 15 is a front view showing soil deposited on an LCD module during transport. In the display area 103 of the LCD module 101, linear soil marks form in two areas 121 that are a fixed distance from both edges of the LCD module 101, as shown in FIG. 15. Irregularly shaped soil marks also form in an irregularly shaped area 122 between the areas 121. The soiling occurs on the inner side of the protective film 111, and can be removed when wiped with a cloth or the like, but time must be spent to wipe the screens at the transport destination. Also, the display area 103 of the LCD modules 101 is liable to be accidentally damaged during the wiping operation.

SUMMARY OF THE INVENTION

An object of the present invention is to provide cushioning material and packing material for display modules that can prevent soiling from occurring on the display area of the display module, and a transport method for display modules that uses the packing material.

The present invention provides a cushioning material for protecting a display module provided with a display screen having a display area and a frame area around the periphery of the display area, the cushioning material having a supporting portion for holding only the frame area and supporting the display module, and a pop-out prevention portion for preventing the display module from popping outside of the cushioning material.

In the present invention, since the supporting portion holds only the frame area of the display module, the display area does not rub against the supporting portion, and soiling can be prevented from occurring in the display area. Since a pop-out prevention portion is provided, the display modules can be prevented from popping-out outside of the cushioning material.

The packing material of the present invention has the cushioning material and a box for storing the cushioning material.

The packing material may have a film for covering the display area of the display module, and a bag for storing the display module.

According to another aspect, the present invention provides a packing material for packing a display module provided with a display screen having a display area and a frame area around the periphery of the display area, the packing material having a film for covering the display area of the display module, a bag for storing the display module, cushioning material for protecting the display module stored in the bag, and a box for storing the cushioning material.

The bag is preferably larger than the display module and is folded back in accordance with the external shape of the display module, and the folded excess portion does not overlap the convexity of the display module. The neighboring bags for packing the LCD modules can thereby be prevented from making contact with each other, and soiling can be controlled.

The bag is preferably larger than the display module and is folded back in accordance with the external shape of the display module, and the folded excess portion is fixed with tape to an area outside the excess portion in the bag. The neighboring bags for packing the LCD modules can thereby be prevented from making contact with each other, and soiling can be controlled.

A plurality of the display modules are preferably stored in a mutually parallel arrangement. The length of a first side of the bag is greater than A and less than (A+Y), and the length of a second side orthogonal to the first side of the bag is greater than B and less than (B+X), where A is the length in a first direction parallel to the display screen in the display module, B is the length in a second direction parallel to the display screen and orthogonal to the first direction, Y is the length of the shortest route from the edge in the first direction in a first display module to a second display module disposed next to the first display module, and X is the length of the shortest route from the edge in the second direction in the first display module to a second display module disposed next to the first display module. The neighboring bags for packing the LCD modules can thereby be prevented from making contact with each other, and soiling can be controlled.

The present invention provides a method for transporting a display module, the method comprising transporting the display module while the module is packed with the packing material.

In accordance with the present invention, soiling can be prevented from occurring on the display area, because the display area of the display module is prevented from rubbing.

DESCRIPTION OF THE PREFERRED EMBODIMENTS

Figure 1:
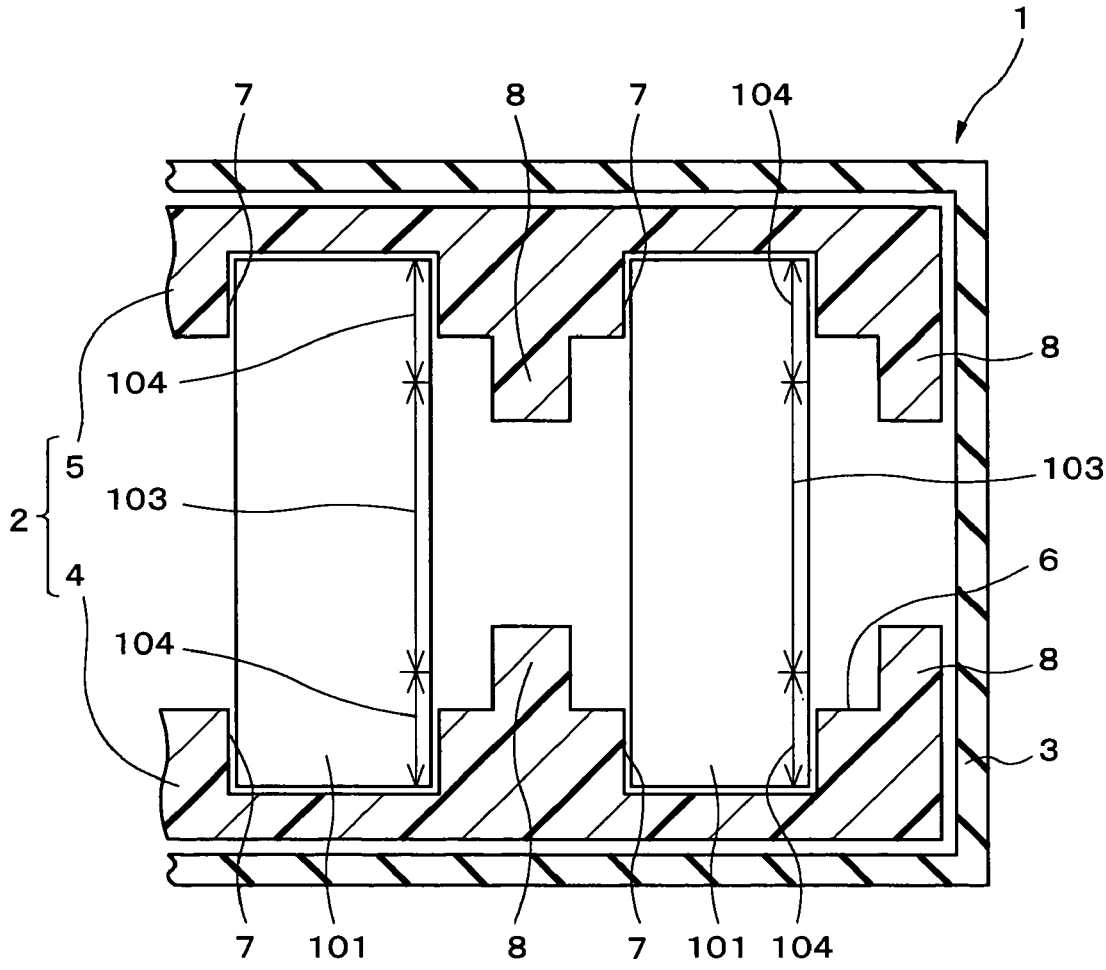
FIG. 1 is a cross-sectional diagram showing the packing material of the first embodiment of the present invention.

The embodiments of the present invention are described in detail below with reference to the attached diagrams. Described first is the first embodiment of the present invention. FIG. 1 is a cross-sectional diagram showing the packing material of the present embodiment. The packing material 1 of the present embodiment is composed of a protective film 111 that is applied to the display screen 102 of the LCD module 101 (see FIG. 14), a vinyl bag 113 in which the LCD module is stored (see FIG. 2), a cushioning material 2 that holds the upper and lower edges of the LCD module 101, and a box 3 in which the cushioning material 2 is stored together with the LCD module 101, as shown in FIG. 1. The box 3 is formed from paper, for example. The configuration of the LCD module 101 is as described in the Description of Prior Art. In FIG. 1, the protective film and bag are not shown for simplicity of description, and the same applies to other diagrams described below.

The cushioning material 2 is composed of a lower member 4 that supports the lower edge of the LCD module 101, and an upper member 5 that supports the upper edge of the LCD module 101. A plurality of LCD modules 101 are thereby stored between the lower member 4 and upper member 5 in a mutually parallel arrangement in the thickness direction of the LCD module 101. The lower member 4 and upper member 5 are formed from foamed styrene, for example. The shape of the lower member 4 and the shape of the upper member 5 are mutually the same. In view of this fact, a description of an example of the shape of the lower member 4 is provided below.

The shape of the lower member 4 is a rectangular parallelepiped overall. A plurality of grooves 7 are formed mutually parallel on the upper surface 6 of the lower member 4. The width of the grooves 7 is slightly greater than the edge of the LCD module 101, and fitting the edges of the LCD module into the grooves allows the grooves to form a supporting portion that supports the edges of the LCD module. Also, the depth of the grooves 7 is less than the width of the frame area 104 of the LCD module 101.

Upwardly protruding convexities 8 are formed in the areas between the grooves 7 in the upper surface 6, and in the areas on both sides of the rows composed of a plurality of grooves 7. More specifically, the convexities 8 are formed on both sides of the grooves 7. The shape of the convexities 8 is a rectangular parallelepiped that extends in the lengthwise direction of the grooves 7, and the shape of the cross section orthogonal to the lengthwise direction is a rectangular shape. The total value of the depth of the grooves 7 and the height of the convexities 8, that is to say, the height from the bottom surface of the grooves 7 to the upper surface of the convexities 8, is greater than the width of the frame area 104 of the LCD module 101. The convexities 8 function as a pop-out prevention portion that prevents the LCD modules 101 from popping out from the cushioning material 2 as the LCD module 101 are being transported.

Figure 14:
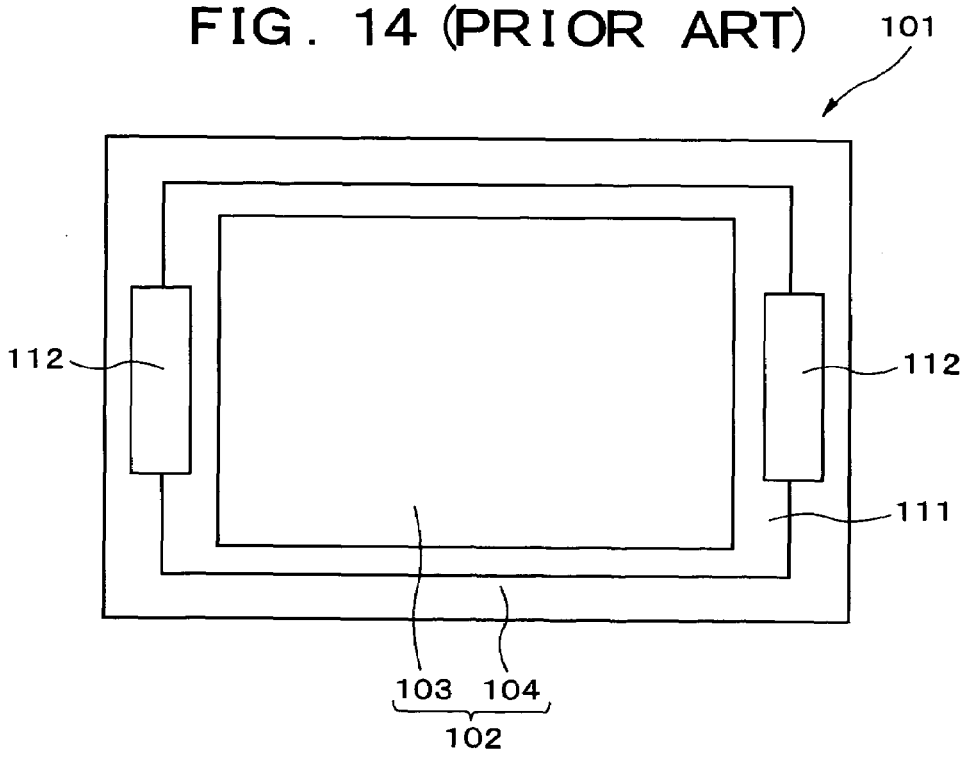
FIG. 14 (PRIOR ART)
FIG. 14 is a front view showing an LCD module during transport.

Described next is the method of using the packing material of the present embodiment configured as described above, in other words, the display module transport method of the present embodiment. First, a protective film 111 is applied to the display screen 102 of each LCD module 101, as shown in FIG. 14. At this time, the protective film 111 is applied so as to cover the display area 103 by using tape 112. Next, the LCD modules 101 are stored using a single vinyl bag 113 per unit (see FIG. 2). The lower member 4 of the cushioning material 2 is placed in the bottom portion of the box 3. In this case, the upper surface 6 of the lower member 4, in other words, the surface on which the grooves 7 and convexities 8 are formed, is set so as to face upward.

Figure 2:
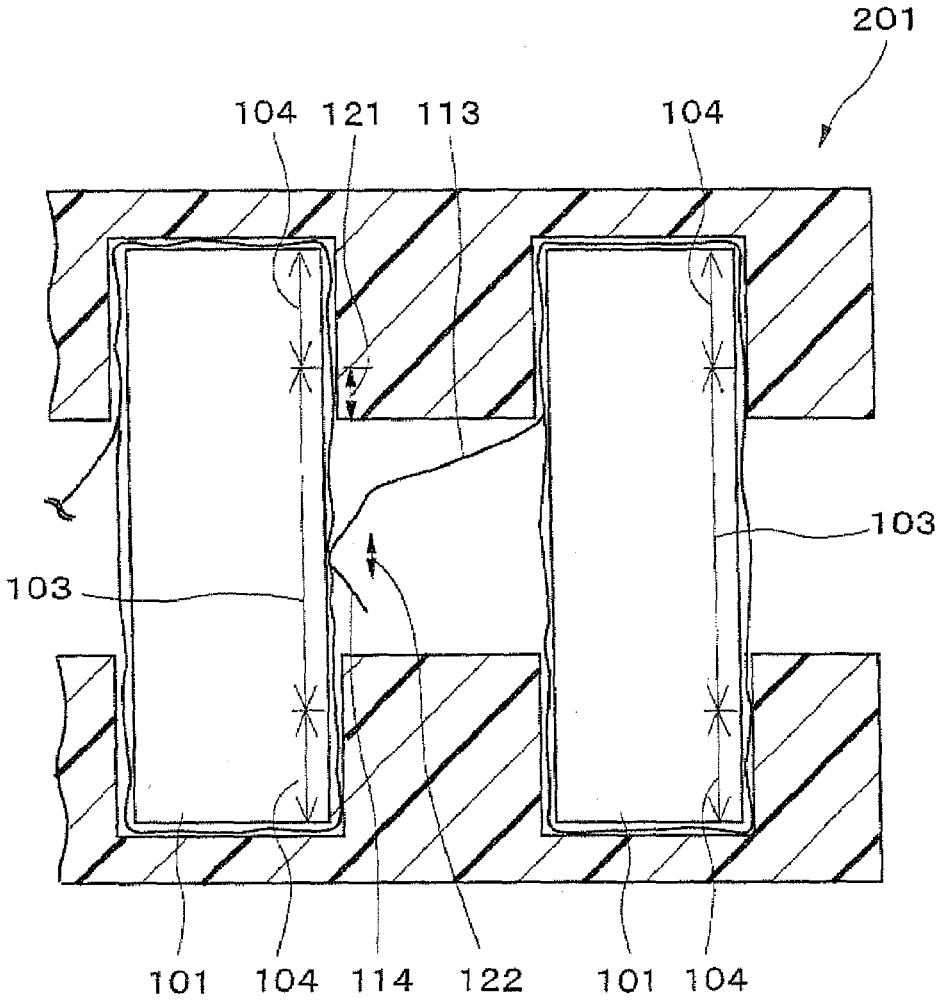
FIG. 2 PRIOR ART
FIG. 2 is a cross-sectional diagram showing the mechanism by which soiling occurs in the conventional method for transporting LCD modules.

Next, the protective film 111 is applied (see FIG. 14), the LCD modules 101 stored in the vinyl bags 113 (see FIG. 2)

are placed in the box 3, and the lower edges of the LCD modules 101 are fitted into the grooves 7 of the lower member 4, as shown in FIG. 1. In this situation, the same number of LCD modules 101 as the number of grooves 7 formed in the lower member 4 are placed in the box 3. The protective film and vinyl bags are not shown in FIG. 1.

The upper member 5 of the cushioning material 2 is placed in the box 3 so that the surface in which the grooves 7 and convexities 8 are formed faces downward, and the grooves 7 of the upper member 5 are fitted to the upper edges of the LCD modules 101. The cushioning material 2 is thereafter fixed to the box 3 by sealing the box. The LCD modules 101 are thereby fixed in place in the box 3 by way of the cushioning material 2. In this state, a plurality of LCD modules 101 are then transported together with the packing material 1.

The effects of the present embodiment are described next. The present inventors thoroughly studied the cause of soiling during the transport of the LCD modules described above. As a result, it was deduced that a portion of the protective film is scraped away when the protective film rubs against the polarizing plates of the LCD modules, and soil is deposited on the polarizing plate, although the soil may be easily removed by cleaning. In view of this situation, the present inventors perfected the present invention having developed a packing material that does not allow the display area of an LCD module to rub against the protective film when the LCD module is transported.

Figure 12:
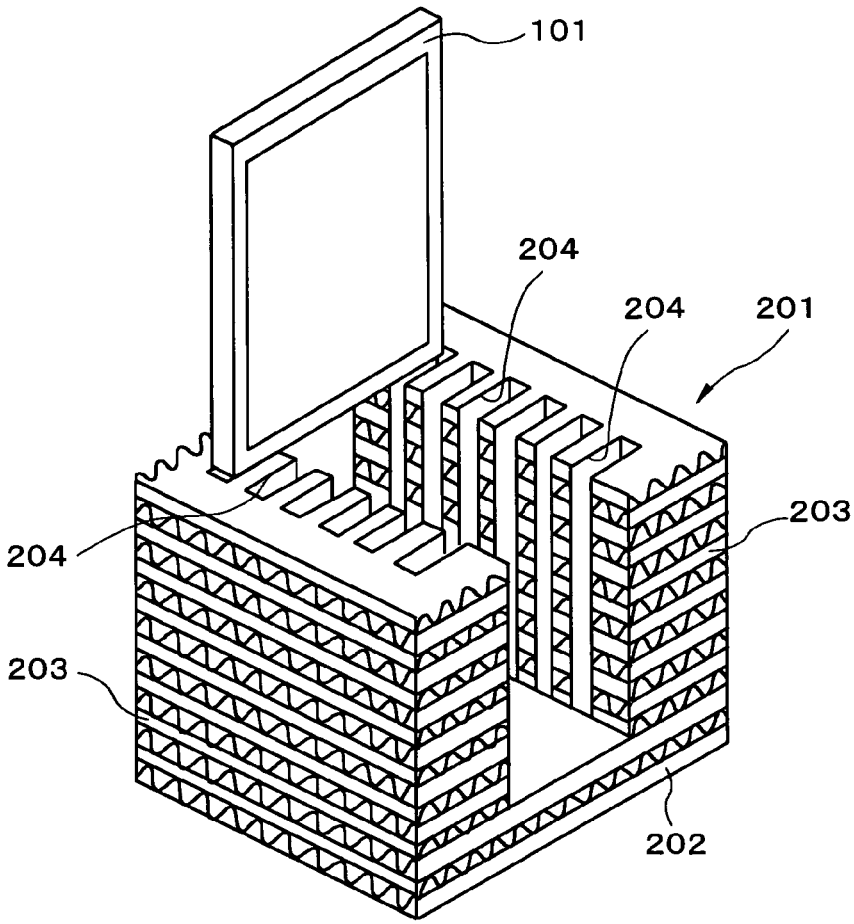
FIG. 12 (PRIOR ART)
FIG. 12 is a perspective view showing the conventional cushioning material described in Japanese Laid-Open Patent Application No. 11-100087.

FIG. 2 is a cross-sectional diagram showing the mechanism by which soiling occurs in the conventional method for transporting LCD modules. The conventional cushioning material 201 holds both ends of each LCD module 101 with notches 204 to keep the LCD modules 101 in place, as shown in FIGS. 12 and 2. In this situation, the depth of the notches 204 must be made deeper than the width of the frame areas 104 of the LCD modules 101 in order to securely hold the LCD modules 101. It is for this reason that an area that is pressed by the side wall of the notches 204 is produced at the edges of the display areas 103 of the LCD modules 101. This area is area 121 shown in FIG. 15, the protective film 111 makes contact with the polarizing plates of the display areas 103 in the area 121, and soiling occurs because the protective film is scraped away.

As described above, the LCD modules 101 are packed by using a single vinyl bag per unit. When a plurality of LCD modules are stored in a single cushioning material 201, as shown in FIG. 2, the end portion 114 of the vinyl bag that contains a particular LCD module 101 makes contact with and presses against the vinyl bag 113 that contains the LCD module 101 disposed to the rearward side of the LCD module 101, in other words, the side opposite that of the display surface. This contact area is area 122 shown in FIG. 15. In area 122, the protective film 111 makes contact with the polarizing plate of the display area 103, and the protective film is scraped away, leading to an occurrence of soiling.

In contrast, since the depth of the grooves 7 is less than the width of the frame areas 104 of the LCD modules 101 in the present embodiment, as shown in FIG. 1, the sidewall of the grooves 7 does not press against the display area 103. For this reason, the display area 103 and protective film 111 do not rub and the occurrence of soiling in the area 121 shown in FIG. 15 can be prevented.

In the present embodiment, convexities 8 are provided in the area between the grooves 7 and in the areas on both sides in the arrangement direction of the rows composed of the grooves 7. The LCD modules 101 can thereby be prevented from popping outside the cushioning material 2 even if vibrations, impacts, and the like occur during transport.

Thus, in accordance with the present embodiment, the cushioning material 2 does not press against the display area 103 of the LCD modules 101 and the occurrence of soiling can be controlled while reliably protecting the LCD modules 101 during transport.

Figure 3:
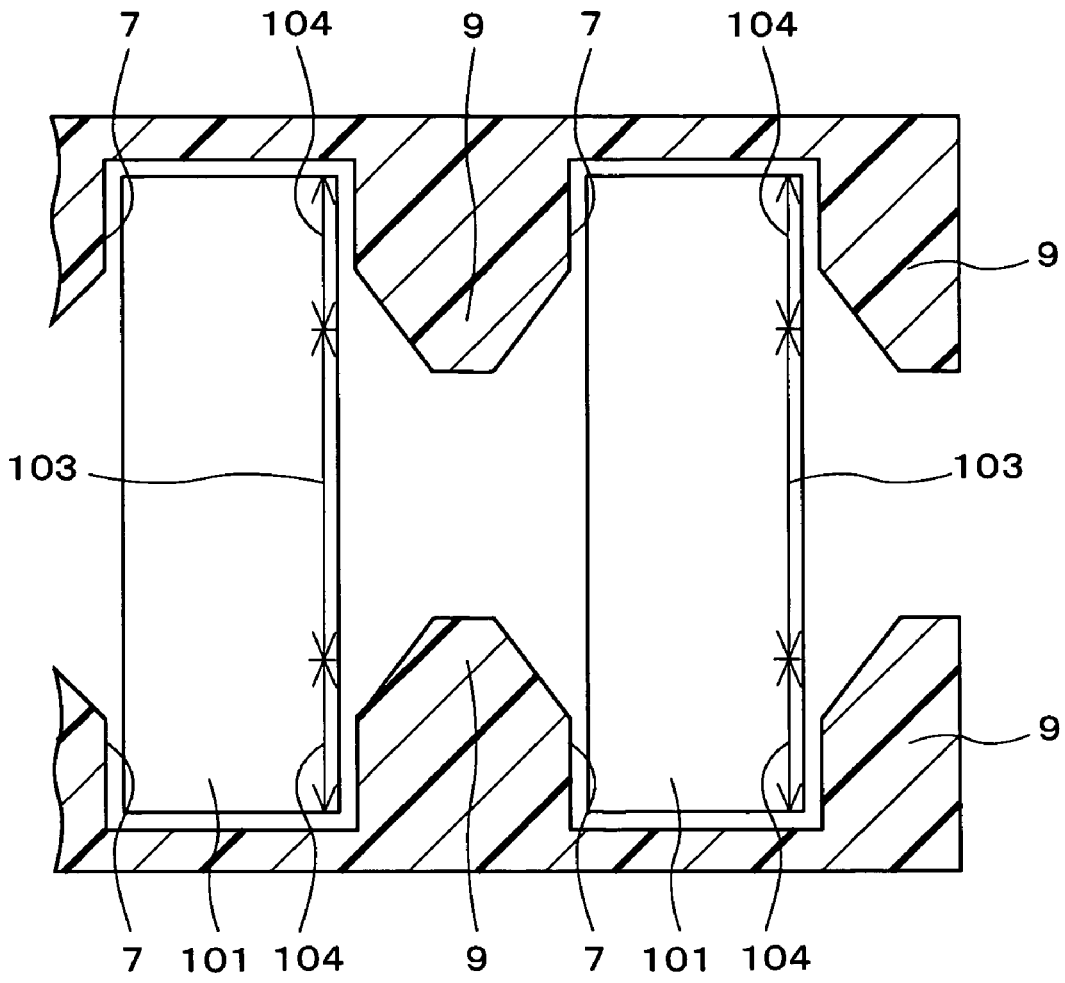
FIG. 3 is a cross-sectional diagram showing the cushioning material of a modified example of the first embodiment.

A modified example of the present first embodiment is described next. FIG. 3 is a cross-sectional diagram showing the cushioning material of the present modified example. Convexities 9 are provided in place of the convexities 8 shown in FIG. 1 in the cushioning material of the present modified example, as shown in FIG. 3. The convexities 9 have a prismatic shape extending in the lengthwise direction of the grooves 7, and the cross-sectional shape in the direction orthogonal to the lengthwise direction is trapezoidal. The side surfaces of the convexities 9 are in contact with the side surfaces grooves 7. The configuration, operation, and effects other than those stated above in the present embodiment are the same as in the first embodiment described above.

Figure 4:
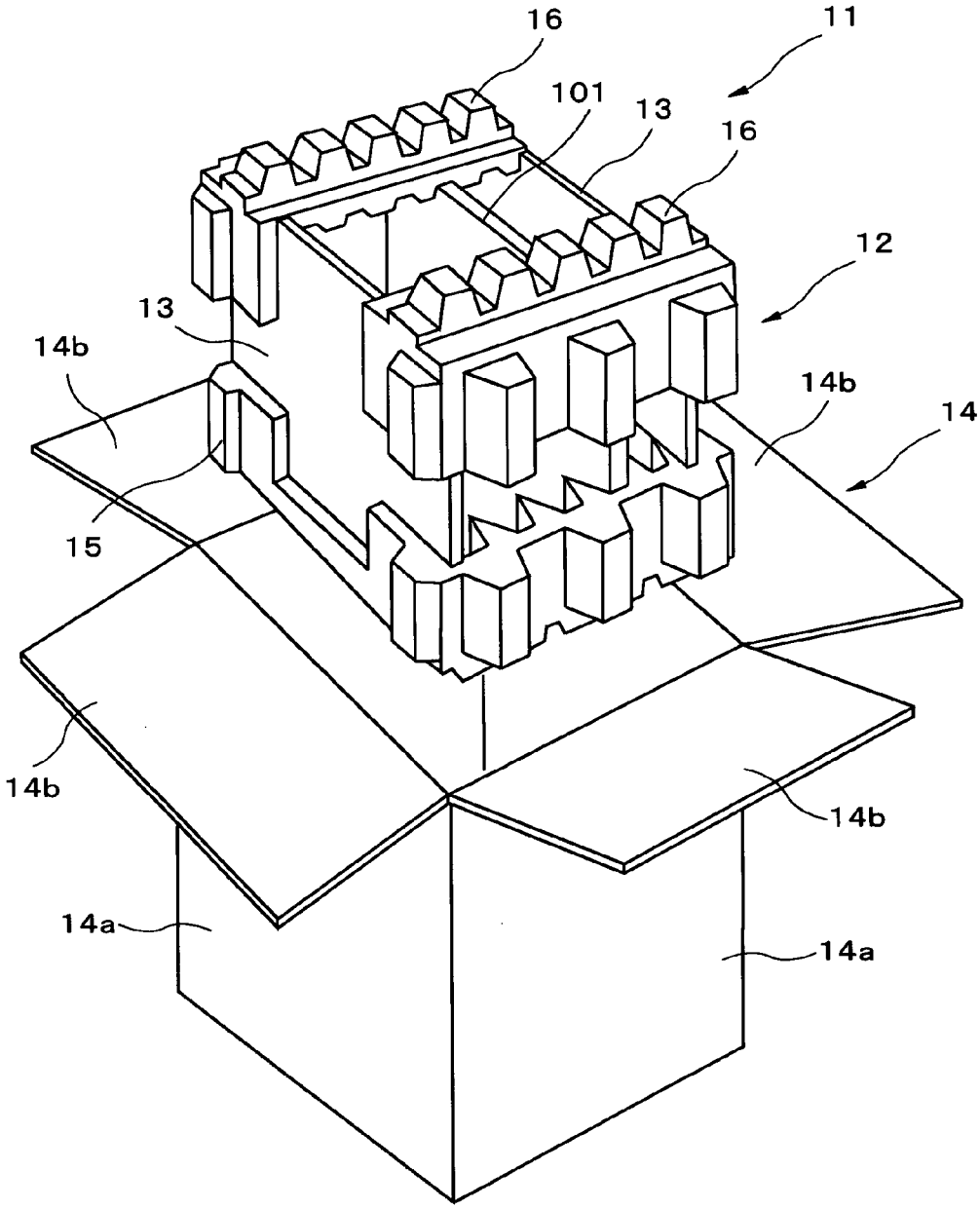
FIG. 4 is a perspective view showing the packing material of the second embodiment of the present invention.
Figure 5:
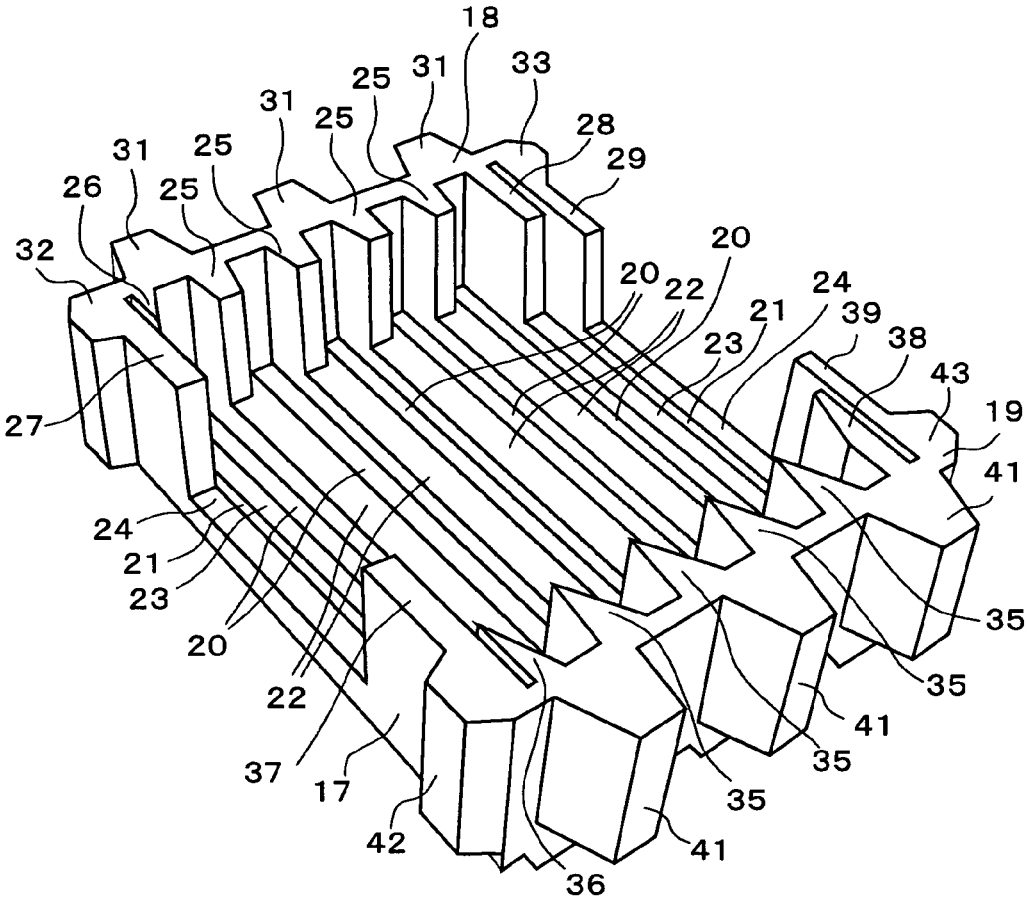
FIG. 5 is a perspective view showing the lower member of the cushioning material in the packing material.
Figure 6:
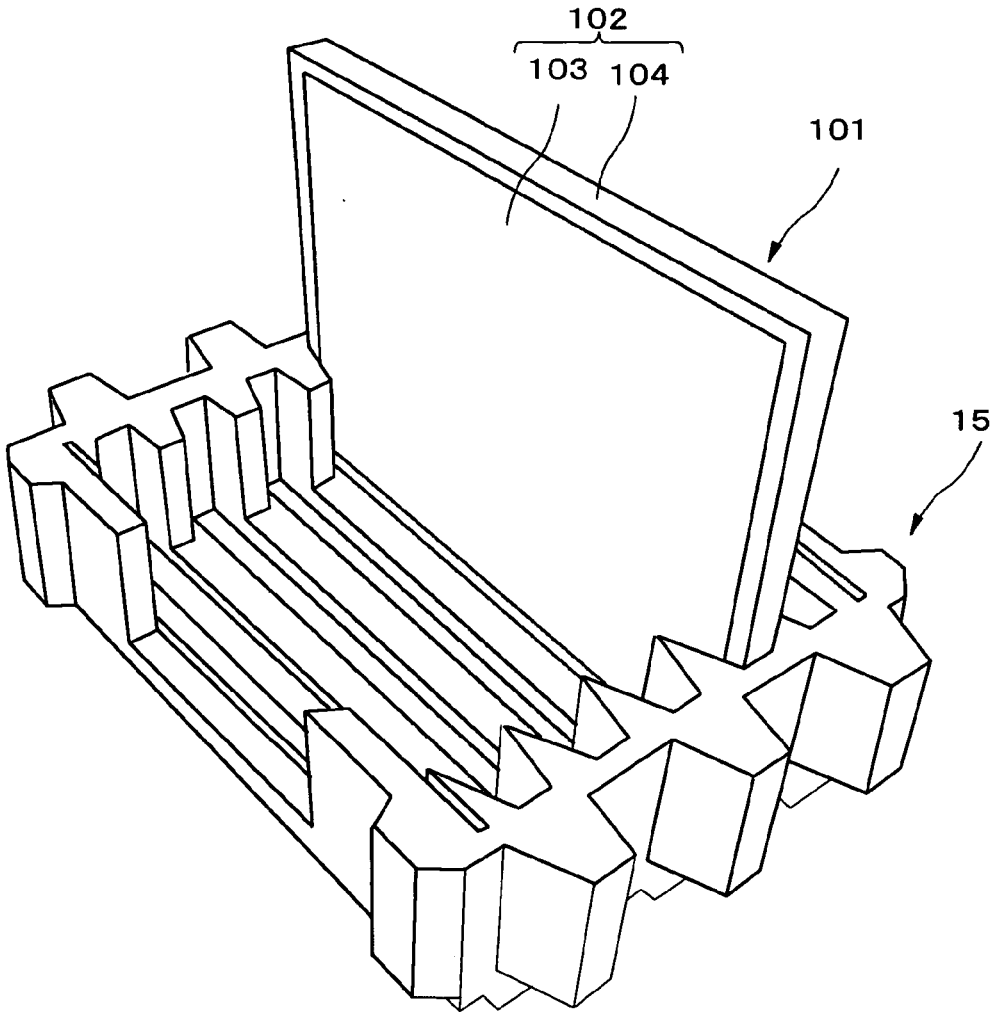
FIG. 6 is a perspective view showing the appearance of an LCD module stored in the lower member.
Figure 7:
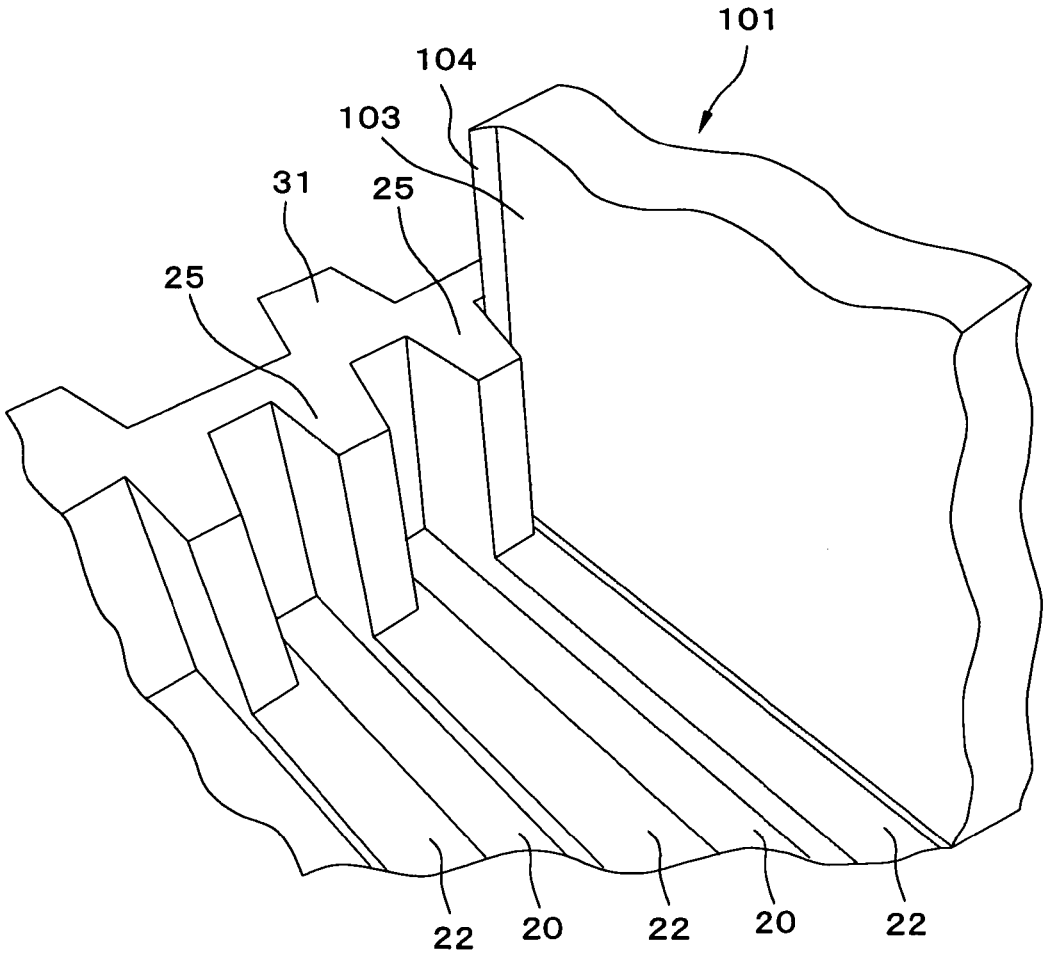
FIG. 7 is a perspective diagram showing a partially enlarged view of the lower member.

The second embodiment of the present invention is described next. FIG. 4 is a perspective view showing the packing material of the present embodiment. FIG. 5 is a perspective view showing the lower member of the cushioning material in the packing material. FIG. 6 is a perspective view showing the appearance of an LCD module stored in the lower member. FIG. 7 is a perspective diagram showing a partially enlarged view of the lower member. The packing material 11 of the present embodiment is composed of a protective film 111 that is applied to the display screen 102 of each LCD module 101 (see FIG. 14), a vinyl bag 113 in which the LCD module is stored (see FIG. 2), a cushioning material 12 that holds the upper and lower edges of the LCD module 101, two plates 13 whose edges are connected to the cushioning material 12, and a box 14 in which the cushioning material 12 and the plates 13 are stored together with the LCD module 101, as shown in FIG. 4.

The box 14 is shaped as a rectangular parallelepiped and is provided with a rectangular bottom surface portion and four lateral portions 14*a* that stand vertically erect from each side of the bottom surface portion. A single lid 14*b* is rotatably attached to each upper edge portion of the lateral portions 14*a*. The upper surface of the box 14 can be opened and closed by rotating the four lids 14*b*. The plates 13 and box 14 are formed from paper, for example. The cushioning material 12 is composed of a lower member 15 that supports the lower end portion of the LCD modules 101, and two upper members 16 that support both sides of the upper end portion of the LCD modules 101. A plurality of LCD modules 101 are thereby stored between the lower member 15 and upper member 16 in a mutually parallel arrangement in the thickness direction of the LCD modules 101. The lower member 15 and upper member 16 are formed from foamed styrene, for example.

A bottom plate 17 is disposed in the lower member 15 of the cushioning material 12, as shown in FIG. 5, and side plates 18 and 19 stand vertically erect, that is, erect in the upward direction from both ends of the bottom plate 17. A plurality of grooves 20, five, for example, are formed on the upper surface of the bottom plate 17 so as to extend in the direction facing away from the side plate 18 toward the side plate 19 (hereinafter referred to as "longitudinal direction"). The width of the grooves 20 is slightly greater than the thickness of the LCD modules 101 (see FIG. 4), and the lower end portions of the LCD modules 101 fit into the grooves 20 so that the lower end portions are supported. The depth of the grooves 20 is slightly less than the width of the frame area 104 of the LCD modules 101. A single groove 21 extending in the longitudinal direction is formed in either edge portion in the upper surface of the bottom plate 17 in the arrangement direction (hereinafter referred to as "cross-wise direction") of the grooves 20. More specifically, a row of grooves 20 is disposed between the two grooves 21. The grooves 21 hold the plates 13. The areas between the grooves 20 in the upper surface of the bottom plate 17 is designated as land portions 22, the areas between the grooves 20 and the grooves 21 are designated as land portions 23, and the outer sides of the grooves 21, that is, the areas corresponding to both ends of the bottom plate 17 are designated as land portions 24.

Columns 25 are formed in the area directly above the land portions 22 in the inner side surface of the side plate 18, that is, the surface of the side facing the side plate 19. The columns 25 have a columnar shape extending in the vertical direction, and the shape as viewed from above is trapezoidal. In other words, the width of the portions of the columns 25 in contact with the side plate 18 is the same width as that of the land portion 22. The side surfaces of the columns 25 are configured so that the side surface of the forward side extends in the longitudinal direction, and the side surface of the rearward side is sloped in the forward direction so that the columns 25 become narrower as the distance from the side plate 18 increases.

A column 26 with a trigonal prismatic shape is formed in the area directly above the land portion 23 of the forward direction in the inner side surface of the side plate 18, and an extended plate 27 that extends in the direction facing the side plate 19 is provided to the area directly above the land portion 24 in the forward direction thereof. An extended plate 28 that extends in the direction facing the side plate 19 is provided to the area directly above the land portion 23 in the rearward direction in the inner side surface of the side plate 19, and an extended plate 29 that extends in the direction facing the side plate 19 is provided to the area directly above land portion 24 in the rearward direction thereof. Thus, the columns 25 and 26 and the extended plates 27 to 29 are disposed on both sides of the grooves 20, and function as pop-out prevention portions that prevent the LCD modules 101 from popping out. Among the columns 25 and 26 and the extended plates 27 to 29, the extended plates 27 and 29 extend the greatest distance in the direction facing the side plate 19, the extended plate 28 extends the second greatest distance, and the columns 25 and 26 extend the least distance. However, the extension distances of the columns 25 and 26 are also greater than the width of the frame area 104 of the LCD modules 101.

Three trapezoidal columnar portions 31 that extend in the vertical direction are formed on the outer surface of the side plate 18. A single trapezoidal columnar portion 32 extending in the vertical direction is formed on the outer surface, that is to say, the front surface of the extended plate 27. A single trapezoidal columnar portion 33 extending in the vertical direction is formed on the outer surface, in other words, the front surface of the extended plate 29. When the lower member 15 is placed inside the box 14, the outer surfaces of the trapezoidal columnar portions 31 to 33 make contact with the inner surface of the box 14, and the trapezoidal columnar portions serve as a cushion against the box 14.

Columns 35 are formed in the areas directly above the land portions 22 on the inner surface of the side plate 19, that is to say, the surface of the side that faces the side plate 18. The columns 35 have a trigonal prismatic shape that extends in the vertical direction. In other words, the width of the portion of the columns 35 that is in contact with the side plate 19 is that same as the width of the land portions 22, and the side surface of the columns 35 is sloped in the crosswise direction so as to become narrower as the distance from the side plate 19 increases.

A column 36 with a trigonal prismatic shape is formed in the area directly above the land portion 23 of the forward direction in the inner side surface of the side plate 19, and an extended plate 37 that extends in the direction facing the side plate 18 is provided to the area directly above the land portion 24 in the forward direction thereof. An extended plate 38 that extends in the direction facing the side plate 18 is provided to the area directly above the land portion 23 in the rearward direction in the inner side surface of the side plate 18, and an extended plate 39 that extends in the direction facing the side plate 18 is provided to the area directly above land portion 24 in the rearward direction thereof. Thus, the columns 35 and 36 and the extended plates 37 to 39 are disposed on both sides of the grooves 20, and function as pop-out prevention portions that prevent the LCD modules 101 from popping out. Among the columns 35 and 36 and the extended plates 37 to 39, the extended plates 37 and 39 extend the greatest distance in the direction facing the side plate 18, the extended plate 38 extends the second greatest distance, and the columns 35 and 36 extend the least distance. However, the extension distances of the columns 35 and 36 are also greater than the width of the frame area 104 of the LCD modules 101.

Three trapezoidal columnar portions 41 that extend in the vertical direction are formed on the outer surface of the side plate 19. A single trapezoidal columnar portion 42 extending in the vertical direction is formed on the outer surface, that is to say, the front surface of the extended plate 37. A single trapezoidal columnar portion 43 extending in the vertical direction is formed on the outer surface, in other words, the front surface of the extended plate 39. When the lower member 15 is placed inside the box 14, the outer surfaces of the trapezoidal columnar portions 41 to 43 make contact with the inner surface of the box 14, and the trapezoidal columnar portions serve as a cushion against the box 14.

Of the two upper members 16, the shape of the upper member 16 disposed in the area directly above the side plate 18 is a shape in which the portions that face the side plate 18 in the lower member 15 are vertically symmetrical. The shape of the upper member 16 disposed in the area directly above the side plate 19 is a shape in which the portions that face the side plate 19 in the lower member 15 are vertically symmetrical.

Described next is the method of using the packing material of the present embodiment configured as described above, that is to say, the method of transporting display modules according to the present embodiment. First, protective film 111 is applied to the display screens 102 of LCD modules 101 (see FIG. 14) by the same method as that of the first embodiment described above, and the modules are stored using a single vinyl bag 113 per unit.

The lower member 15 of the cushioning material 12 is placed in the bottom of the box 14. In this situation, the surface of the lower member 15, in other words, the surface on which the grooves 20 are formed is set so as to face upward. The outer surfaces of the trapezoidal columnar portions 31 to 33 and 41 to 43 of the lower member 15 are brought into contact with the inner surface of the box 14, and the lower member 15 is fixed to the box 14.

Next, the protective film 111 is applied (see FIG. 14) and the LCD modules 101 stored in the vinyl bags (see FIG. 2) are placed in the box 14, as shown in FIG. 6. The lower end portion of the LCD modules 101 are fitted into the grooves 20 of the lower member 15. The grooves 20 thereby support the lower end portion of the LCD modules 101. The same number of LCD modules 101 as grooves 20, five, for example, are placed in the box 14. The protective film and vinyl bag are not depicted in FIG. 6.

In this case, since the depth of the grooves 20 is less than the width of the frame areas 104 of the LCD modules 101, as shown in FIG. 7, the lower end portions of the display areas 103 of the LCD modules 101 are positioned outside of the grooves 20. For this reason, the side surfaces of the grooves 20 do not press against the display areas 103. Also, the front surface of the column 25 makes contact with the vinyl bags that cover the back surfaces of the LCD modules 101, but since the rear surface of the column 25 is sloped in the forward direction, no contact is made with the bags that cover the display areas 103 of the LCD modules 101.

Next, two plates 13 are fitted into the grooves 21 of the lower member 15. One end of the plate 13 of the forward side is held by the column 26 and the extended plate 27, the other end is held by the column 36 and the extended plate 37, and the plate is fixed to the lower member 15. One end of the plate 13 of the rear side is held by the extended plate 28 and the extended plate 29, the other end is held by the extended plate 38 and the extended plate 39, and the plate is fixed to the lower member 15.

Next, the two upper members 16 of the cushioning material 12 are placed in the box 14 so that the surface on which the grooves are formed faces downward, the grooves 20 of the upper member 16 are fitted onto both sides of the upper end portions of the LCD modules 101, and the grooves 21 are fitted onto both sides of the upper end portions of the plates 13. The upper surface of the box 14 is thereafter covered by the lid 14*b* of the box 14, and the box 14 is sealed. At this time, the trapezoidal columnar portions formed in the outer surface of the upper member 16 make contact with the inner surface of the box 14, and the upper member 16 is fixed to the box 14. The LCD modules 101 are thereby fixed to the box 14 by way of the cushioning material 12. In this state, a plurality of LCD module 101 are transported together with the packing material 11.

The effects of the present embodiment are described next. In the present embodiment, the grooves 20 formed in the lower member 15 and upper member 16 of the cushioning material 12 support the LCD modules 101 by holding the upper and lower end portions of the LCD modules 101. In this situation, the depth of the grooves 20 is formed so as to be less than the width of the frame area 104, and the side surfaces of the grooves 20 therefore do not press against the display area 103. It is because of this fact that soiling caused by the grooves 20 does not occur in the display area of the LCD modules.

Columns 25 and 35 are formed between the LCD modules 101, extended plates 27 and 37 are provided in the forward direction of the row of LCD modules 101, extended plates 29 and 39 are provided in the rearward direction of the row of LCD modules 101, and two plates 13 are provided so as to sandwich the row of LCD modules 101. The LCD modules 101 can thereby be prevented from popping outside of the cushioning material 12 even if an impact, vibrations, or other external forces are applied to the box 14 as the LCD modules 101 are being transported. Conversely, since the columns 25 and 35 do not press against the display area 103 of the LCD modules during ordinary transport, soiling caused by the columns 25 and 35 does not occur in the display area of the LCD modules.

Thus, in accordance with the present embodiment, the cushioning material 12 does not press against the display area 103 of the LCD modules 101, and the occurrence of soiling can be controlled while reliably protecting the LCD modules 101 during transport.

In the present embodiment, the columns 25 and 35 and extended plates 27, 29, 37, and 39 that prevent the LCD modules 101 from popping out extend from the side plates 18 and 19 of the lower member 15 toward the inner side. The side plates 18 and 19 are thereby securely fixed to the bottom plate 17, and the rigidity of the lower member 15 and upper member 16 can be increased.

In the present embodiment, the trapezoidal columnar portions 31 to 33 and 41 to 43 that are formed on the exterior of the cushioning material 12 served as a cushion against the box 14. The shock resistance of the packing material 1 can thereby be further enhanced.

In the present embodiment, the cushioning material 12 is divided between the lower member 15 and upper member 16. Therefore, the lower member 15, LCD modules 101, and upper member 16 can be placed in the box 14 in the stated order when the LCD modules 101 are to be stored in the box 14; and the upper member 16 and LCD modules 101 can be removed in the stated order when the LCD modules 101 are to be removed from the box 14. The storage of the LCD modules 101 in the box 14 and their removal can therefore be simplified. Since the upper member 16 is divided into to two parts, the weight of the cushioning material 12 can be reduced while the material can still deliver the required protective performance.

Figure 8A:
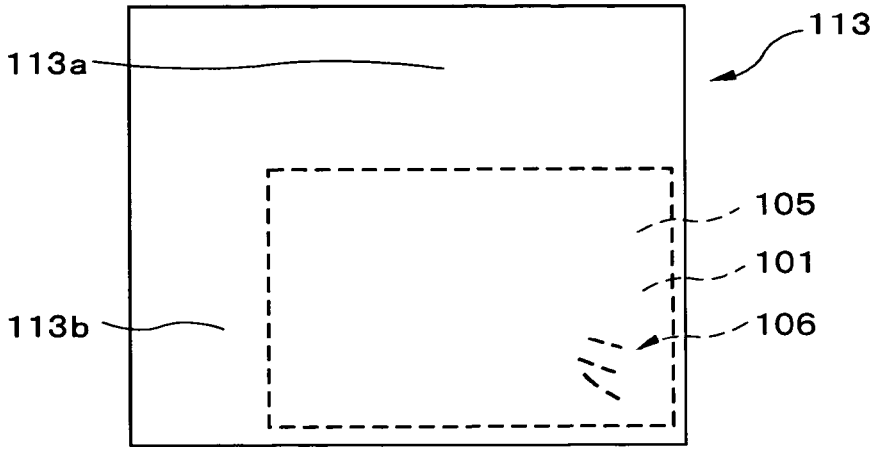
FIGS. 8A to 8C are front views showing the step sequence of the method for packing an LCD module in the third embodiment of the present invention.
Figure 8B:
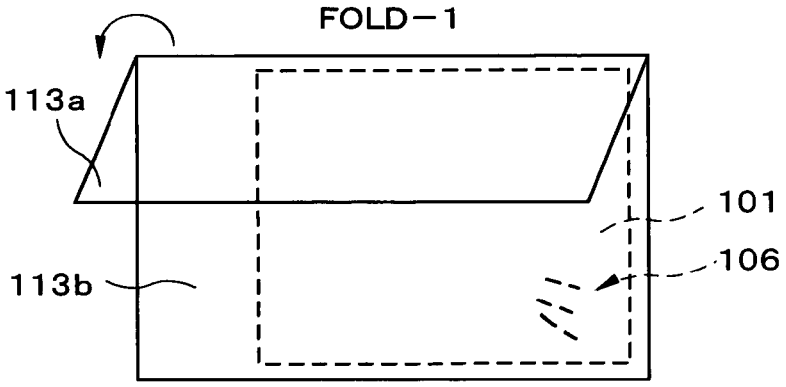
Figure 8C:
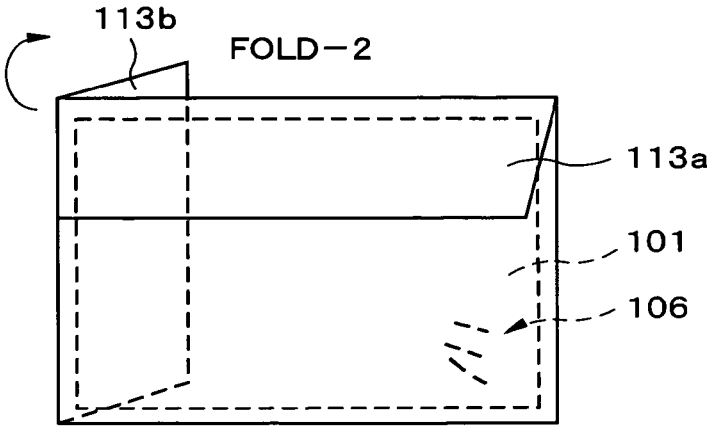
Figure 13:
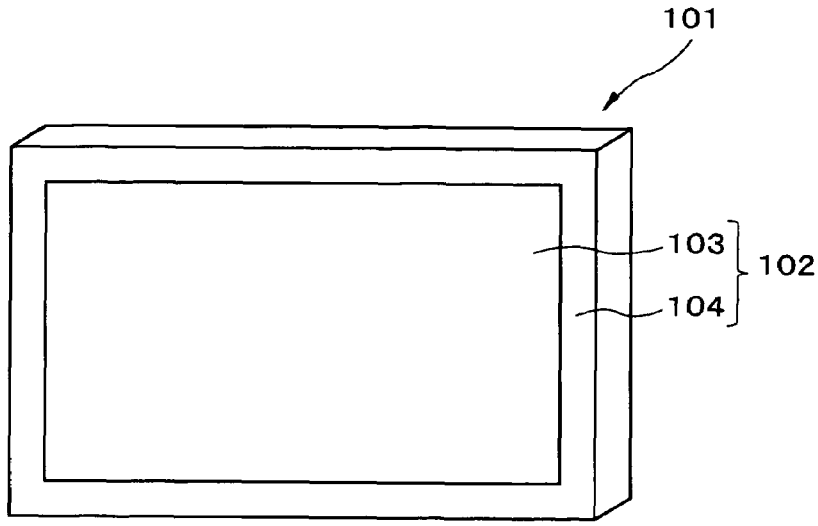
FIG. 13 (PRIOR ART)
FIG. 13 is a perspective view showing an LCD module.

The third embodiment of the present invention is described next. FIGS. 8A to 8C are front views showing the step sequence of the method for packing an LCD module in the third embodiment. A lead wire 106 connected to the backlight of the LCD module 101 is attached to the back surface 105 of the LCD module 101, in other words, the surface opposite that of the display screen 102 (see FIG. 13), as shown in FIG. 8A. The configuration of the packing material of the present embodiment is the same as in the first embodiment described above.

The transport method for display modules of the present embodiment is described below. First, the LCD module 101 is stored in a vinyl bag 113, and the corner portion nearest to the lead wire 106 in the LCD module 101 is brought into contact with a corner portion of the vinyl bag 113. In this case, the vinyl bag 113 is larger than the LCD module 101. Therefore, for example, the side portion on the side farthest from the lead wire 106 and the upper portion (end portion that faces the opening) in the vinyl bag 113 become surplus portions 113*a* and 113*b*, respectively. These portions do not make contact with the LCD module 101.

Next, the upper portion of the vinyl bag 113, that is, the surplus portion 113*a* is folded back along the upper end portion of the LCD module 101, as shown in FIG. 8B. In this state, the surplus portion 113*a* can be folded back toward the display screen 102 or the back surface 105, but the surplus portion 113*a* is made to avoid overlapping the lead wire 106. In the present embodiment, the surplus portion 113*a* is folded back to the back surface 105, for example.

Next, the side portion of the vinyl bag 113, that is, the surplus portion 113*b* is folded back along the side edge of the LCD module 101, as shown in FIG. 8C. In this state, the surplus portion 113*b* can be folded back toward the display screen 102 or the back surface 105, but the surplus portion 113*b* is made to avoid overlapping the lead wire 106. In the present embodiment, the surplus portion 113*b* is folded back to the display screen 102, for example.

In the present embodiment, the upsurge of the vinyl bag 113 can be controlled by folding back the surplus portions 113*a* and 113*b* of the vinyl bag 113 so as to avoid overlapping the lead wire 106. In other words, large upsurges in the vinyl bag 113 due to the surplus portions of the vinyl bag 113 overlapping the lead wire 106 and other projections can be prevented. A vinyl bag 113 packed with an LCD module is not liable to make contact with the vinyl bag 113 packed with an LCD module disposed adjacent thereto, and soiling is not liable to occur in the irregular area 122 shown in FIG. 15.

Figure 9:
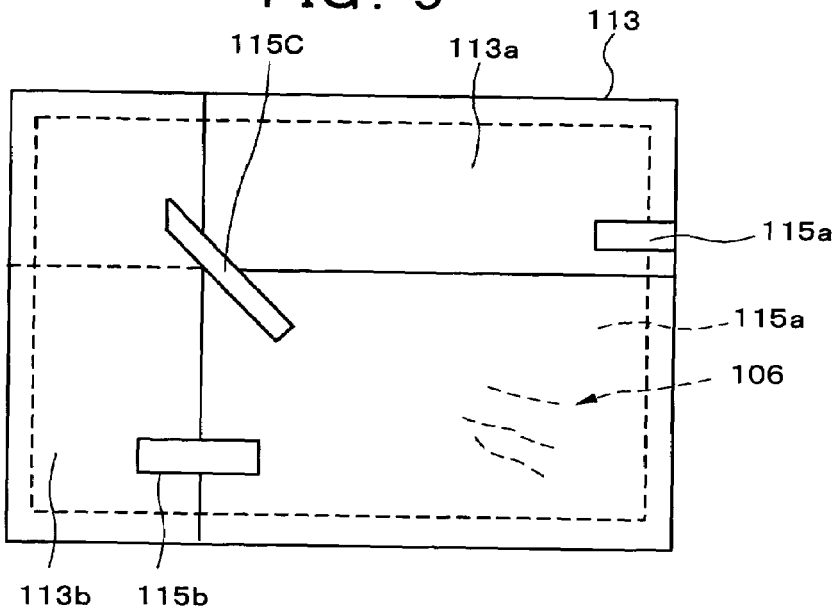
FIG. 9 is a front view showing the method for packing an LCD module in the fourth embodiment of the present invention.

The fourth embodiment of the present invention is described next. The configuration of the packing material of the present embodiment is the same as that of the first embodiment described above. FIG. 9 is a front view showing the method for packing an LCD module in the present embodiment. In the present embodiment, an LCD module 101 is packed in the vinyl bag 113 in the same manner as in the third embodiment described above, as shown in FIG. 9. In other words, the surplus portions of the vinyl bag 113 are folded so as to avoid overlapping the lead wire 106 and other projecting portions of the LCD module 101. In the present embodiment, the surplus portions 113*a* and 113*b* of the vinyl bag 113 are folded to the back surface 105 of the LCD module 101, for example.

The folded surplus portion 113*a* is fixed to an area outside the surplus portion of the vinyl bag 113 by using tape 115*a*. Also, the folded surplus portion 113*b* is fixed to an area outside the surplus portion of the vinyl bag 113 by using tape 115*b*. Tape 115*c* is applied and the surplus portions 113*a* and 113*b* are furthermore fixed to an area outside the surplus portion of the vinyl bag 113 so as to cover the intersection between the edge of the surplus portion 113*a* and the edge of the surplus portion 113*b*. The configuration, operation, and effects other than those stated above in the present embodiment are the same as in the third embodiment described above.

In the present embodiment, the bulging of the vinyl bag 113 can be controlled by fixing the surplus portions 113*a* and 113*b* of the vinyl bag 113 to areas outside the surplus portion by using tapes 115*a* and 115*c*. A vinyl bag 113 packed with an LCD module is thereby not liable to make contact with the vinyl bag 113 packed with an LCD module disposed adjacent thereto, and soiling is not liable to occur in the indefinite area 122 shown in FIG. 15.

In the present embodiment, the surplus portions 113*a* and 113*b* of the vinyl bag 113 are both folded back to the back surface 105 side of the LCD module 101, but the surplus portions 113*a* and 113*b* may be folded back to the display screen 102 side or may be separately folded back to the back surface 105 side and the display screen 102 side.

Figure 10:
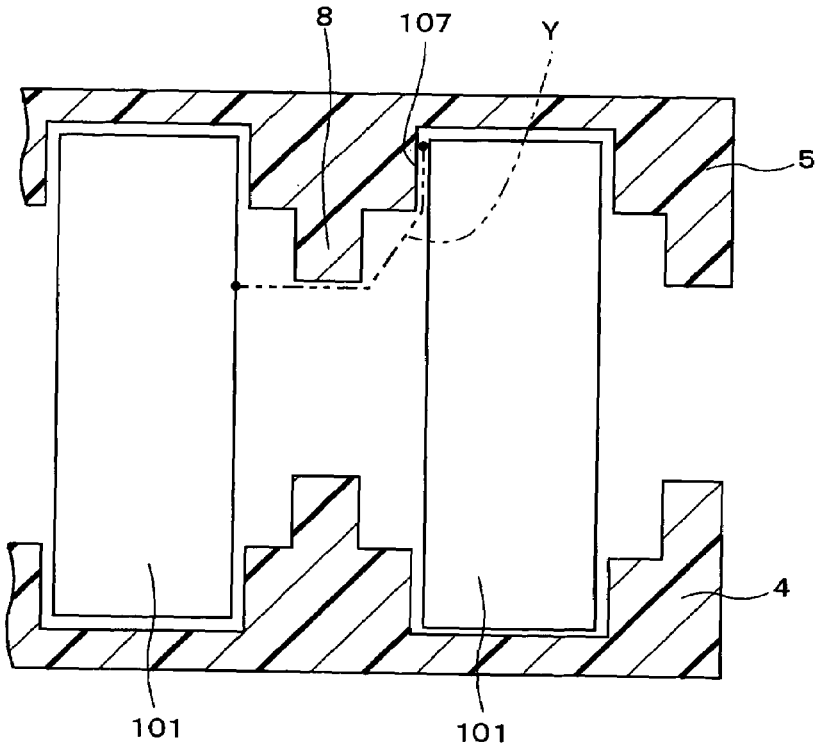
FIG. 10 is a cross-sectional view showing the cushioning material of the fifth embodiment of the present invention.
Figure 11:
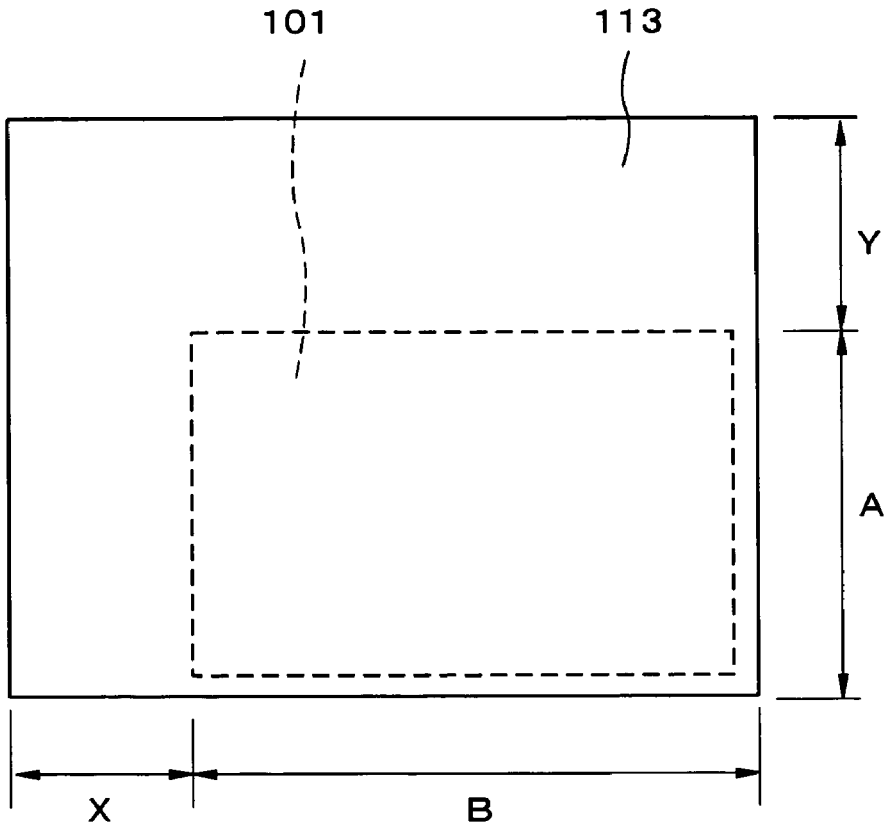
FIG. 11 is a front view showing the bag in the present embodiment.

The fifth embodiment of the present invention is described next. FIG. 10 is a cross-sectional view showing the cushioning material of the present embodiment, and FIG. 11 is a front view showing the bag in the present embodiment. In the present embodiment, in a state in which a plurality of LCD modules 101 are placed inside the cushioning material 2, Y (cm) is the length of the shortest route from the upper end portion 107 of the display screen 102 of one LCD module 101 to another LCD module disposed facing the display screen 102 of the first LCD module, as shown in FIG. 10. Also, X (cm) is the length of the shortest route from the side edge of the display screen 102 of one LCD module 101 to another LCD module disposed facing the display screen 102 of the first LCD module.

The length of one side of the vinyl bag 113 is greater than the length A (cm) in the vertical direction of the LCD module 101, and is less than the length (A+Y) (cm) in which the length Y (cm) of the above-described shortest route is added to the length A (cm), as shown in FIG. 11. The length of the other side of the vinyl bag 113 is greater than the length B (cm) in the longitudinal direction of the LCD module 101, and is less than the length (B+X) (cm) in which the length X (cm) of the above-described shortest route is added to the length B (cm). The configuration and operation other than those stated above in the present embodiment are the same as in the first embodiment described above.

In the present embodiment, the size of the vinyl bag 113 is defined as described above, whereby the surplus portions can be prevented from making contact with the vinyl bag 113 for storing an adjacent LCD module, without the surplus portions of the vinyl bag 113 being fixed with tape as in the fourth embodiment described above. Soiling can thereby be prevented from occurring in the irregularly shaped area 122 shown in FIG. 15 without increasing costs.

As described above, the occurrence of soiling can be reliably prevented by setting the length of one side to be less than (A+Y) and the length of the other side to be less than (B+X) in the vinyl bag 113. However, the effect of reducing the occurrence of soiling can be obtained to a certain extent even if the lengths of one side and the other side may be slightly greater than the above-described (A+Y) and (B+X), respectively, in other words, even if the length of one side is $(A+Y+\alpha)$ and the length of the other side is $(B+X+\beta)$. The surplus portion that is oriented vertically when the LCD module is packed sags downward from the upper end portion of the LCD module. Therefore, the surplus portion is constricted by its own weight and does not considerably bulge toward the adjacent LCD module. For this reason, the length of the surplus portion can be made greater than the surplus portion that is oriented horizontally when the LCD module is packed. More specifically, the value of $\alpha$ noted above can be set to be greater than the value of $\beta$ if it is assumed that the first side is oriented vertically when the LCD module is packed and the other side is oriented horizontally when the LCD module is packed.

In the third to fifth embodiments described above, the folding direction of the surplus portions may be the display screen side or back surface side of the LCD module, but the folding direction to the display screen side is advantageous for reducing soiling. The reason for this is described below. When the surplus portions are folded to the back surface side of the LCD module, the surplus portions of the bag packed with an adjacent LCD module are disposed on the display screen side as viewed from the LCD module. Since the natural vibration frequencies of an LCD module and the adjacent LCD module are different, the bag of the adjacent LCD module moves relative to the LCD module when vibrated, and the display region of the LCD module is rubbed. This is the cause of soiling. In contrast, when the surplus portion is folded back to the display screen side, the surplus portions of the bag packed with the LCD module are disposed on the display screen side as viewed from the LCD module. In this case, the LCD module and the surplus portions of the bag packed with the LCD module move in a substantially synchronous manner, and the display screen of the LCD module and the surplus portions of the bag therefore remain stationary relative to each other. For this reason, the display area of the LCD module is not rubbed and the likelihood of soiling is reduced.

Figure 15:
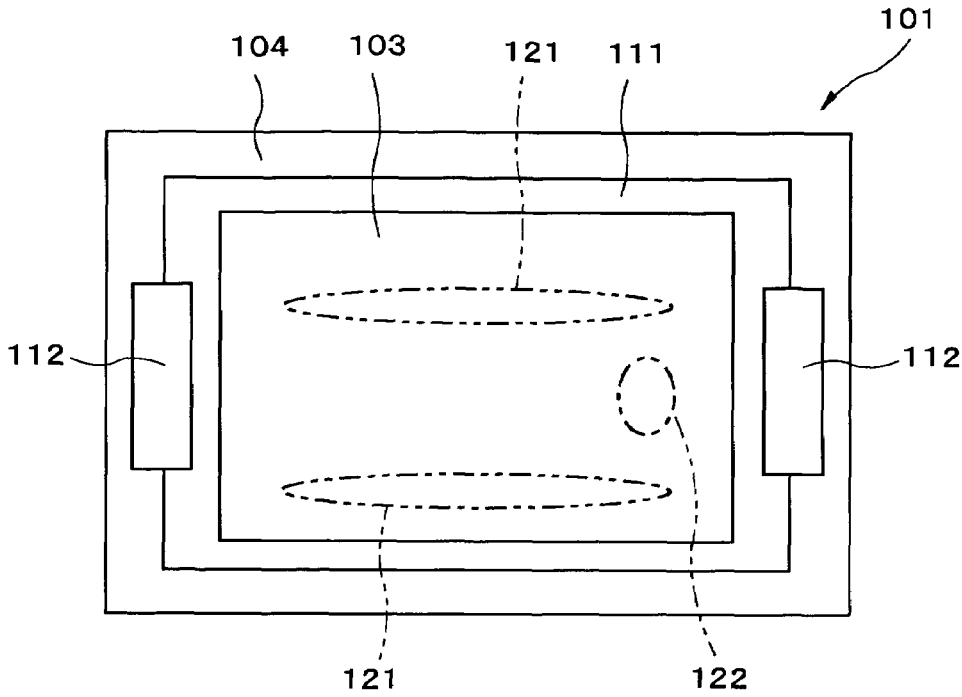
FIG. 15 (PRIOR ART)
FIG. 15 is a front view showing soil deposited on an LCD module during transport.

In accordance with the first embodiment, the modified example of the first embodiment, and the second embodiment as described above, the occurrence linear soil marks can be prevented in the areas 121 shown in FIG. 15. In accordance with the third to fifth embodiments described above, the occurrence of irregularly shaped soil marks can be prevented in the area 122 shown in FIG. 15. Therefore, the occurrence of soiling can be prevented in the areas 121 and 122 by combining the use of any of the first embodiment, the modified example of the first embodiment, and the second embodiment described above with the use of any of the third to fifth embodiments described above. However, the embodiments and modified examples of the embodiments described above produce a certain set of effects even if used alone.

What is claimed is:

1. A cushioning material for protecting a display module in combination with said display module, said display module (101) comprising a display screen (103) and a frame around a periphery of said display screen, said frame (104) having a first width measured from said display screen to an edge of said display module; and said cushioning material (2) comprising a groove (7) in which said frame is seated and that has spaced apart parallel sides and a second width measured from a bottom of said groove to a top of said sides, said second width being less than said first width so that said sides hold said frame and avoid contact with said display screen, and a pop-out prevention portion (8,9) that prevents said display module from popping outside of said cushioning material, said pop-out prevention portion being an extension of said sides of said groove beyond said first width and recessed relative to said sides so that said pop-out prevention portion overlaps said display screen without contacting said display screen.

2. The combination according to claim 1, said cushioning material having a first portion disposed along a first edge of said display module, and a second portion disposed along a second edge facing said first edge of said display module, wherein each of said groove and said pop-out prevention portion is provided to both of said first and second portions.

3. The combination according to claim 2, wherein said first portion and said second portion are mutually separated.

4. The combination according to claim 2, wherein said first portion and said second portion are mutually connected.

5. The combination according to claim 1, wherein the pop-out prevention portion is a convexity formed on both sides of said groove.

6. The combination according to claim 5, wherein the convexity extends along the direction in which said groove extends, and the shape of the cross section orthogonal to the lengthwise direction thereof is rectangular.

7. The combination according to claim 5, wherein said convexity extends along the direction in which said groove extends, and the shape of the cross section orthogonal to the lengthwise direction thereof is trapezoidal.

8. The combination according to claim 1, wherein said display module is an LCD module.

9. The combination according to claim 1, further comprising a box in which said display module and said cushioning material are stored.

10. The combination according to claim 1, further comprising a film covering said display screen and a bag in which said display module is stored.

11. The combination according to of claim 10, wherein said bag is larger than said display module and is folded back in accordance with the external shape of said display module to form a folded excess portion, and said folded excess portion does not overlap a lead wire of said display module.

12. The combination according to claim 11, wherein said folded excess portion is fixed with tape to said bag.

13. The combination according to claim 1, wherein a plurality of said display modules are stored in a mutually parallel arrangement, A is the length in a first direction parallel to the display screen in said display module, B is the length in a second direction parallel to said display screen and orthogonal to said first direction, Y is the length of the shortest route from the edge in said first direction in a first display module to a second display module disposed next to the first display module, X is the length of the shortest route from the edge in said second direction in the first display module to a second display module disposed next to the first display module, the length of a first side of said bag is greater than A and less than (A+Y), and the length of a second side orthogonal to the first side of said bag is greater than B and less than (B+X).

14. The combination according to claim 11, wherein said bag is larger than said display module and is folded back to the display screen side of the display module in accordance with the external shape of said display module.

15. A cushioning material for protecting plural display modules in combination with said plural display modules, each of said plural display modules comprising a display screen and a frame around a periphery of said display screen, said frame having a first width measured from said display screen to an edge of said display module; and said cushioning material comprising plural parallel grooves, a respective said frame being seated in each of said grooves, each of said grooves having spaced apart parallel sides and a second width measured from a bottom of said groove to a top of said sides, said second width being less than said first width so that said sides hold a respective said frame and avoid contact with said display screen, and plural pop-out prevention portions that each prevents a respective one of said display modules from popping outside of said cushioning material, each of said plural pop-out prevention portions being an extension of said sides of a respective one of said grooves beyond said first width and recessed relative to said sides so that each of said plural pop-out prevention portions overlaps the respective said display screen without contacting said display screen.

* * * * *